United States Patent [19]

Finn

[11] 3,972,322

[45] Aug. 3, 1976

[54] FOOT MASSAGING DEVICE

[75] Inventor: William E. Finn, Clinton, Iowa

[73] Assignee: Lawrence Peska Associates, Inc., New York, N.Y. ; a part interest

[22] Filed: Sept. 26, 1975

[21] Appl. No.: 616,914

[52] U.S. Cl. ..... 128/57; 128/25 B

[51] Int. Cl.[2] ..... A61H 15/00

[58] Field of Search ..... 128/57, 24.3, 25 B, 128/67, 65

[56] References Cited

UNITED STATES PATENTS

| | | | |
|---|---|---|---|
| 1,569,467 | 1/1926 | Edwards | 128/57 |
| 1,608,598 | 11/1926 | Heilborn | 128/25 B |
| 1,722,866 | 7/1929 | Snyder | 128/25 B |
| 2,230,890 | 2/1941 | McClenathen | 128/57 |

*Primary Examiner*—Lawrence W. Trapp
*Attorney, Agent, or Firm*—Richard E. Nanfeldt

[57] ABSTRACT

A foot massaging device is used for massaging a foot of user. The device includes a rectangularly shaped housing having a base, a pair of upwardly extending end walls, a pair of upwardly extending sidewalls, an open top, and a chamber therein. A wedge shaped member removably inserts into the chamber, wherein an upper face of the wedge shaped member is inclined downwardly from one end wall to another end wall. A plurality of cylindrically shaped members are contained within the chamber, wherein the circumferential periphery of each cylindrically shaped rollably engages the upper inclined face of the wedge shaped member.

4 Claims, 4 Drawing Figures

FOOT MASSAGING DEVICE

BACKGROUND OF THE INVENTION

U.S. Pat. No. 1,608,598 involves one roller member moving a corrugated surface. This patent fails to provide: a means for engaging the whole foot; the inclined face of the present invention; or a means for readily changing the size of the roller.

U.S. Pat. No. 2,037,495 teaches a roller device having a plurality of longitudinal flutes therein.

U.S. Pat. No. 2,168,842 teaches three juxtapositioned balls as a means for forming a foot massaging device.

These aforementioned patents are non-applicable to my present invention which permits the whole foot to be engaged during a massaging operation.

SUMMARY OF THE INVENTION

My present invention relates to a unique and novel foot massaging device which massages the foot of a user so as to relieve muscle fatigue in the foot as well as improve blood circulation therein.

An object of my present invention is to provide a foot massaging device of relatively simple design and low manufacturing cost, wherein the component parts of the device form a kit which is readily assembled or disassembled so as to accommodate various size feet.

A further object of my present invention is to provide a foot massaging device, wherein a plurality of cylindrically shaped members rollably engage an inclined face within a rectangularly shaped housing.

Briefly, my present invention comprises a rectangularly shaped housing having a base, a pair of upwardly extending end walls, a pair of upwardly extending sidewalls, an open top, and a chamber therein. A wedge shaped member removably inserts into the chamber, wherein an upper face of the wedge shaped member is inclined downwardly from one end wall to another end wall. A plurality of cylindrically shaped members are contained within the chamber, wherein the circumferential periphery of each cylindrically shaped rollably engages the upper inclined face of the wedge shaped member.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 4:
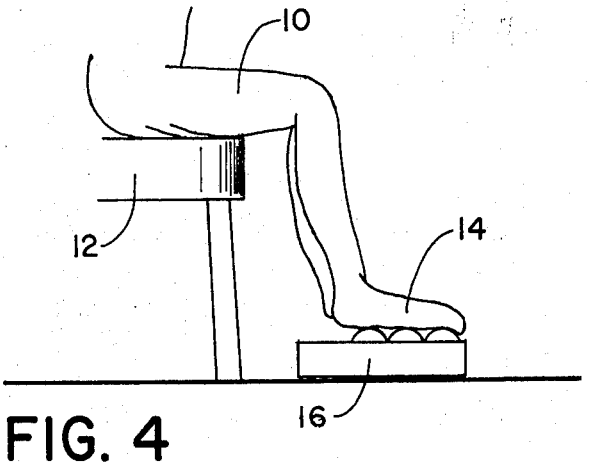
FIG. 4 illustrates a side view of a user applying one of his feet to the foot massaging device.

Turning now descriptively to the drawings, in which similar reference characters denote similar elements throughout the several views, FIG. 4 shows a person 10 sitting on a chair 12, wherein the feet 14 of the person 10 are adapted to be received on a foot massaging device 16.

Figure 1:
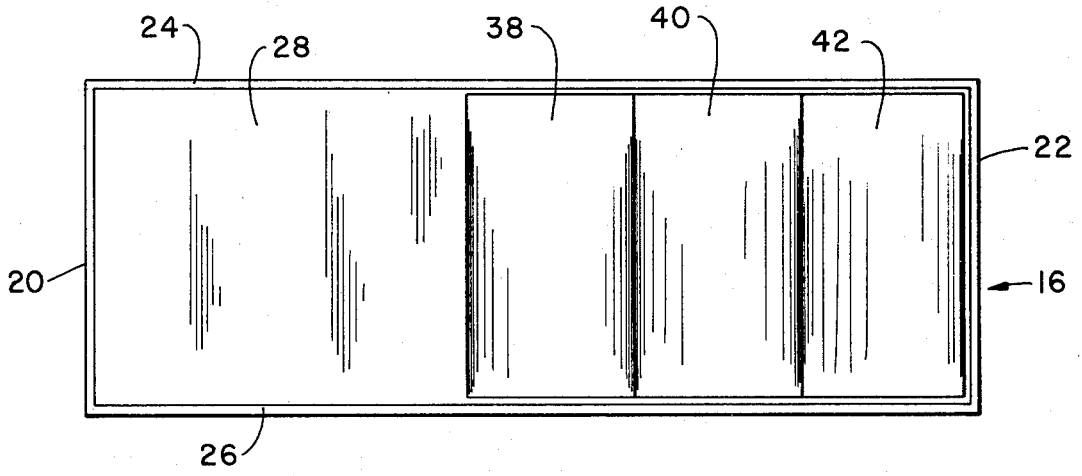
FIG. 1 illustrates a top view of a foot massaging device.
Figure 2:
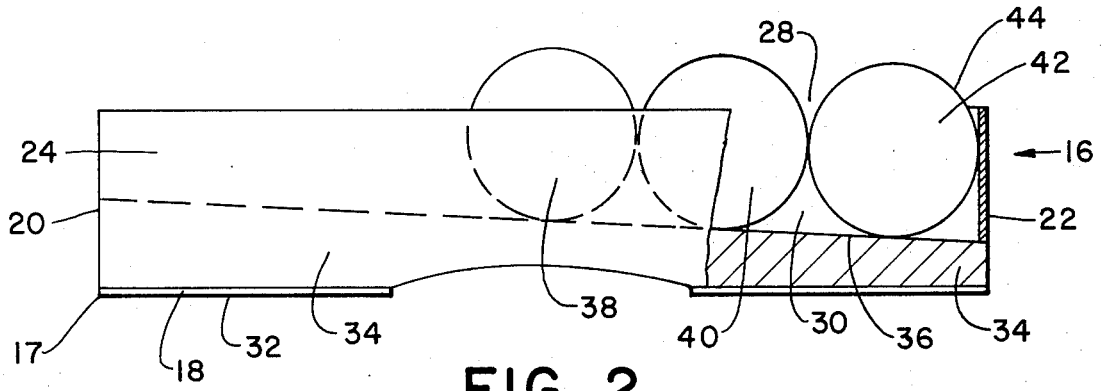
FIG. 2 illustrates a side cross sectional view of the foot massaging device.
Figure 3:
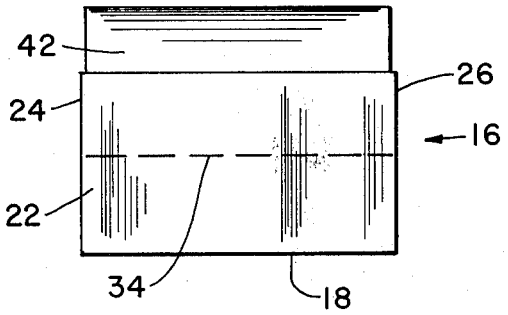
FIG. 3 illustrates an end view of the foot massaging device.

FIGS. 1–3 shows the foot massaging device 16 which comprises a rectangularly shaped housing 17 having a base 18, a pair of upwardly extending end walls 20, 22, a pair of upwardly extending sidewalls 24, 26, an open top 28 and an interior chamber 30 therein. A non-skid pad 32 is affixed onto a lower surface of the base 18 thereby preventing the base 18 from sliding along the floor. A wedge shaped member 34 removably fits into chamber 30 through the open top 28, wherein the upper face 36 of the wedge shaped member 34 is inclined downwardly from one end wall 20 to the other end wall 22. A plurality of various size wedge shaped members 34 are provided thereby providing a plurality of upper faces 36 of different angles of inclinations.

Three cylindrically shaped members 38, 40, 42 are transversely contained in chamber 30, wherein members 38, 40, 42 rollably engage the upper face 36 of the wedge shaped member 34. The diameters of members 38, 40, 42 are sufficient that their circumferential peripheries 44 protrude above the top edges of the sidewalls 24, 26 of housing 17. The user 10 applies his feet 14 to the upper circumferential peripheries of members 38, 40, 42 and rolls members 38, 40, 42 within the housing 17. The rolling action of members 38, 40, 42 causes the foot 14 to be massaged. The degree of inclination of the upper face 36 of member 34 affects the ease with which the members 38, 40, 42 can be rolled. The housing 17, wedge shaped member 34 and cylindrically shaped members 38, 40, 42 are ideally formed from a plastic selected from the group consisting of polyethylene, polypropylene, polyvinyl chloride, nylon, or ABS. The base 18 of housing 17 and the wedge shaped member 34 can be one integral unit. Since members 38, 40, 42 are removable, the size of members 38, 40, 42 can be readily varied so as to accommodate various size feet 14. The upper face 36 of member 34 is adapted to receive thereon a foot medication which is readily transferred to the circumferential peripheries 44 of members 38, 40, 42 for application to the feet 14.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A foot massaging device adapted to receive thereon the feet of a user, which comprises:

a. a housing having a base, a pair of upwardly extending end walls, a pair of upwardly extending sidewalls, an open top, and an interior chamber therein;

b. one of a plurality of wedge shaped members removably contained in said chamber, an upper inclined face of one said wedge shaped member extending downwardly from one said end wall to another said end wall; and c. at least two cylindrically shaped member contained in said chamber and rollably engaging said upper face of said wedge shaped member, a circumferential periphery of each said cylindrically shaped member extending above the top edges of said sidewalls.

2. A device according to claim 1, wherein a non-skid pad is affixed to a lower surface of said base for engaging the ground.

3. A device according to claim 1, wherein said wedge shaped member and said base are one integral unit.

4. A device according to claim 1, wherein said housing, said cylindrically shaped members, and said wedge shaped members are formed from a plastic selected from the group consisting of polyethylene, polypropylene, polyvinyl chloride, nylon, or ABS.

* * * * *